US005501416A

United States Patent [19]

Capan

[11] Patent Number: 5,501,416

[45] Date of Patent: Mar. 26, 1996

[54] METHOD AND APPARATUS FOR INDUCTIVELY RECEIVING CAB SIGNALING ON BOARD A RAILWAY VEHICLE

[75] Inventor: Ronald R. Capan, Pittsburgh, Pa.

[73] Assignee: Union Switch & Signal Inc., Pittsburgh, Pa.

[21] Appl. No.: 275,991

[22] Filed: Jul. 15, 1994

[51] Int. Cl.[6] ..... B61L 1/00

[52] U.S. Cl. ..... 246/63 R; 246/194; 246/196

[58] Field of Search ..... 246/1 C, 8, 63 R, 246/63 C, 63 A, 29, 34 R, 28 K, 175, 194, 196; 340/933, 941

[56] References Cited

U.S. PATENT DOCUMENTS

| | | | |
|---|---|---|---|
| 1,328,865 | 1/1920 | Woodward | 246/63 R |
| 1,824,145 | 9/1931 | Howe | 246/63 A |
| 2,000,266 | 5/1935 | Espenschied | 246/63 A |
| 2,064,641 | 12/1936 | Bossart | 246/63 R |
| 2,067,116 | 1/1937 | Brown | 246/63 A |
| 3,201,583 | 8/1965 | Rolle | 246/63 R |
| 3,840,737 | 10/1974 | Hoyler | 246/63 R |
| 4,274,611 | 6/1981 | Salmon | 246/63 R |
| 4,487,385 | 12/1984 | Salmon | 246/63 R |
| 4,720,067 | 1/1988 | Jaeger | 246/63 R |
| 5,263,670 | 11/1993 | Colbaugh et al. | 246/63 R |

*Primary Examiner*—Mark T. Le
*Attorney, Agent, or Firm*—Buchanan Ingersoll

[57] ABSTRACT

A cab signaling apparatus for use on board a railway vehicle which is propelled on rail tracks by an electric drive motor. The invention utilizes a cab signal transmitted to the vehicle through a track circuit in the rails. On board receiving of the cab signal is done by a receiving coil, which may be mounted in front of the lead axle, as a current transformer around the lead axle, or at another location where the cab signal current is relatively strong. The cab signal that is sensed has a cab signal component and an interference component. On board the vehicle a sampled signal is taken which has the characteristic of the electromagnetic interference subjected to the cab signal receiver coil. The sampled signal is then subtracted from the sensed cab signal such that the sampled interference signal cancels the interference component of the cab signal. Embodiments include placing the sampling device as an inductive coil behind the lead axle and in other embodiments in front of the lead axle above the cab signal sensing coil. A series arrangement with selective polarity on the coils permits a vital arrangement. In some embodiments the sampling to achieve a sampled signal characteristic of electromagnetic interference is done by using a current transformer coil on the electric drive motor cable.

27 Claims, 4 Drawing Sheets

METHOD AND APPARATUS FOR INDUCTIVELY RECEIVING CAB SIGNALING ON BOARD A RAILWAY VEHICLE

BACKGROUND OF THE INVENTION

In railway transportation systems it is often desirable to transmit information to a rail vehicle by the use of cab signaling. The information desired to be transmitted is encoded into a cab signal current which is transmitted to the vehicle through the rails. When the cab signaling current reaches the vehicle, the signal information may be detected and the information utilized by the vehicle. Some of the information transmitted may be of a nature that is desirable to be known by those on board the vehicle, and may be information is redundant with wayside signaling information. However, in some instances it may be desirable that the cab signaling information transmits data to the vehicle which is vital to the operation of the vehicle, such as speed commands, and track conditions which effect the operation of the vehicle. This information can be received by the vehicle through antenna usually positioned in front of the lead axle which inductively couple to the cab signal current which is in the rail in front of the lead axle. The lead axle tends to act as a shunt between the rails and therefore the positioning of the cab signal antenna or inductive coupling is usually done in close proximity to, but in front of the lead axle. This inductively coupled pick-up is an adequate means to receive cab signal information by vehicles which are not powered by frequency varying electric motors. Frequency varying electric drive motors, such as AC propulsion motors used on board locomotives, utilize high current variable frequency electric power. Frequency varying electric drive motors, such as AC locomotive motors, can produce a high level of electromagnetic interference to the cab signal. Cab signal frequencies in the rail current are usually at frequencies of 60 hertz and 100 hertz. The AC drive locomotives use variable frequency, variable amplitude control techniques to drive three-phase traction motors. These propulsion motors draw currents in the order of magnitude of hundreds of amperes. In addition, over the speed range of operation of the locomotive, the frequency range of the propulsion motor current varies over a broad range. At certain speeds and/or propulsion currents the locomotive motor current will have frequency components that will be close to or equal to the cab signal frequency, such as 60 hertz and 100 hertz. Because the locomotive routinely operates over various speed ranges the interference presented by the AC propulsion current can be expected to be encountered at any time during operation, and often enough so as to present a problem to the reliable receipt of AC track signal information.

One solution to avoid the interference between the cab signal system and the AC propulsion system would be to operate the two systems at different frequencies. If the frequency band of the AC propulsion were to be outside the cab signal frequency bands the problem created by the concurrent operation of both systems would be eliminated. However, the present cab signaling frequencies have been utilized for many years and much of the existing equipment operates at those frequency ranges. It would be impractical to change all of the existing cab signal equipment to different frequencies. Similarly, in the AC locomotive propulsion equipment presently utilized, the horsepower and speed ranges demanded by AC traction motors makes the utilization of frequencies between 50 and 100 highly desirable.

Therefore it is desirable to have a system which would permit compatibility between existing cab signaling equipment and present AC propulsion motor vehicle drive.

SUMMARY OF THE INVENTION

The invention provides a method to receive the cab signal information from the rails and realize that such cab signal has combined with it a certain component which is related to the electromagnetic interference from the alternating current propulsion motor. In addition to receiving the track cab signals the invention also samples a signal that is characteristic of the electromagnetic interference which is being subjected to the cab signal pick-up. Since the cab signal, as received, has an interference component; that component can be removed or substantially reduced by subtracting the sampled signal from the received cab signal. The effect is to cancel the electromagnetic interference component from the sensed track cab signal. In some embodiments it may be desirable to sample a signal which is characteristic of the electromagnetic interference component but has opposite polarity. In that instance the sampled signal can be added to the sensed cab signal, since the polarities of the interference or noise signal are of inversed phase they will tend to cancel. Some of the embodiments of the invention utilize identical pick-up coils positioned relative to the existing cab signal pick-up coils. The sampling devices can consist of a coil or coils positioned on board the locomotive in a location where the sampling device "sees" primarily an interference signal and either a low rail current signal or no rail current signal at all. Flux mapping techniques may be used to determine an optimal location for the sampling device.

DESCRIPTION OF SOME EMBODIMENTS

Figure 1A:
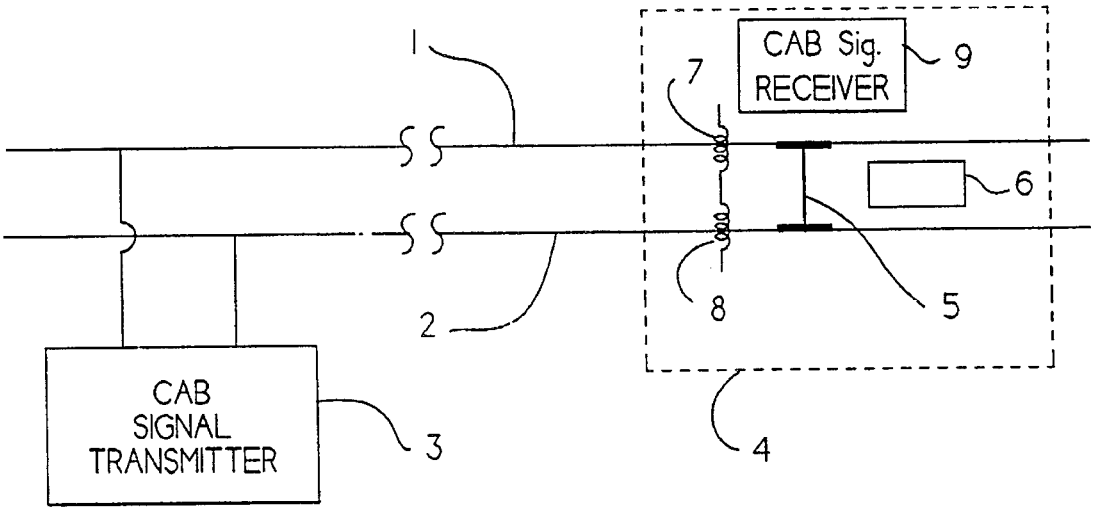
FIG. 1A is a diagrammatic representation of a typical cab signal arrangement.

FIG. 1A shows a typical cab signal system in which a pair of rails 1,2 form a track which will carry a track signal current encoded with information to a vehicle positioned on the track. The vehicle 4, as shown, is moving in a right to left direction in FIG. 1A, and the lead wheel axle assembly 5 is shown. In operation a cab signal transmitter 3 is connected to rails 1 and 2 to feed a cab signal current into the rails. The circuit path is from the cab signal transmitter 3 through rail 1 through the shunt supplied by the wheel and axle assembly 5, and returned to the cab signal transmitter via rail 2. This is a typical track circuit scheme in which the vehicle supplies the shunt between adjacent rails. Usually the majority of track circuit current will go through the lead axle of the vehicle as it advances towards the transmitter. Other portions of the cab signal current may go through loss paths between the rails and a small portion may also go through following wheel and axle assemblies on the vehicle. Therefore it is desirable to place the cab signal receiving coils 7 and 8 in advance of the lead axle, usually 6 to 10 inches above the rail. Additional cab signal receiving apparatus 9 is also located on the vehicle to receive the signal provided by coils 7 and 8 and decode the information from such cab signals for display or utilization on board the vehicle. Most vehicles use electric motors as the primary propulsion drive unit. The motors may be AC or DC, and are usually mounted on the truck assembly to provide a direct gear drive to the vehicle wheel and axle assemblies. In FIG. 1A an AC motor 6 is shown.

Figure 1B:
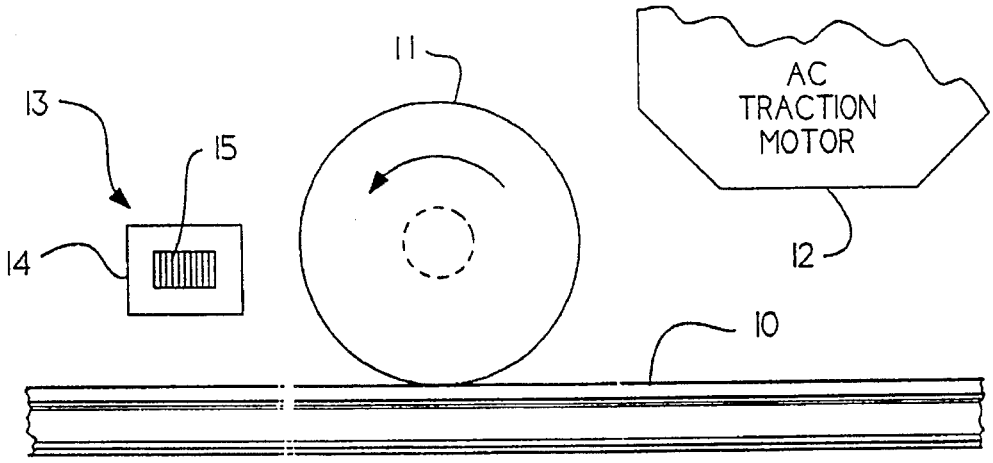
Fig.1b. (Prior Art)
FIG. 1B is a diagrammatic representation showing the arrangement of the cab signal antenna and pick-up coil in relation to the lead axle and rail.

A side view is shown in FIG. 1B which shows the lead axle wheel assembly 11 on rail 10. The cab signal receiving antenna 13 is placed above the rail and in front of the lead axle 11. As such the current beneath the antenna 13 in rail 10 induces an electromagnetic flux in the flux concentrating bars 15 which extend through the cab signal pick-up coil 14. It is desirable to place the cab signal pick-up receiver or antenna, such as 13, in front of the lead axle as the current track cab signal current beneath the pick-up coil is much greater in front of the lead axle than behind the lead axle. This is because the lead axle acts as an electrical shunt and the cab signal current will be directed from the rail 10 into the wheel and axle assembly 11 and electrically connected to the adjacent rail. As a result, the cab signal currents behind the lead axle are zero or significantly less than those in front of the lead axle.

FIG. 1B shows an AC traction motor which is suspended in a well-known manner on the truck or carriage of the rail vehicle and is used to drive the vehicle through well-known propulsion drive mechanical connections. The traction motor and its associated cables and power supply equipment generate a source of high energy variable frequency electromagnetic radiation. This radiation can cause interference with the cab signal reception and may interfere with the antenna pick-up coil 13.

Figure 2:
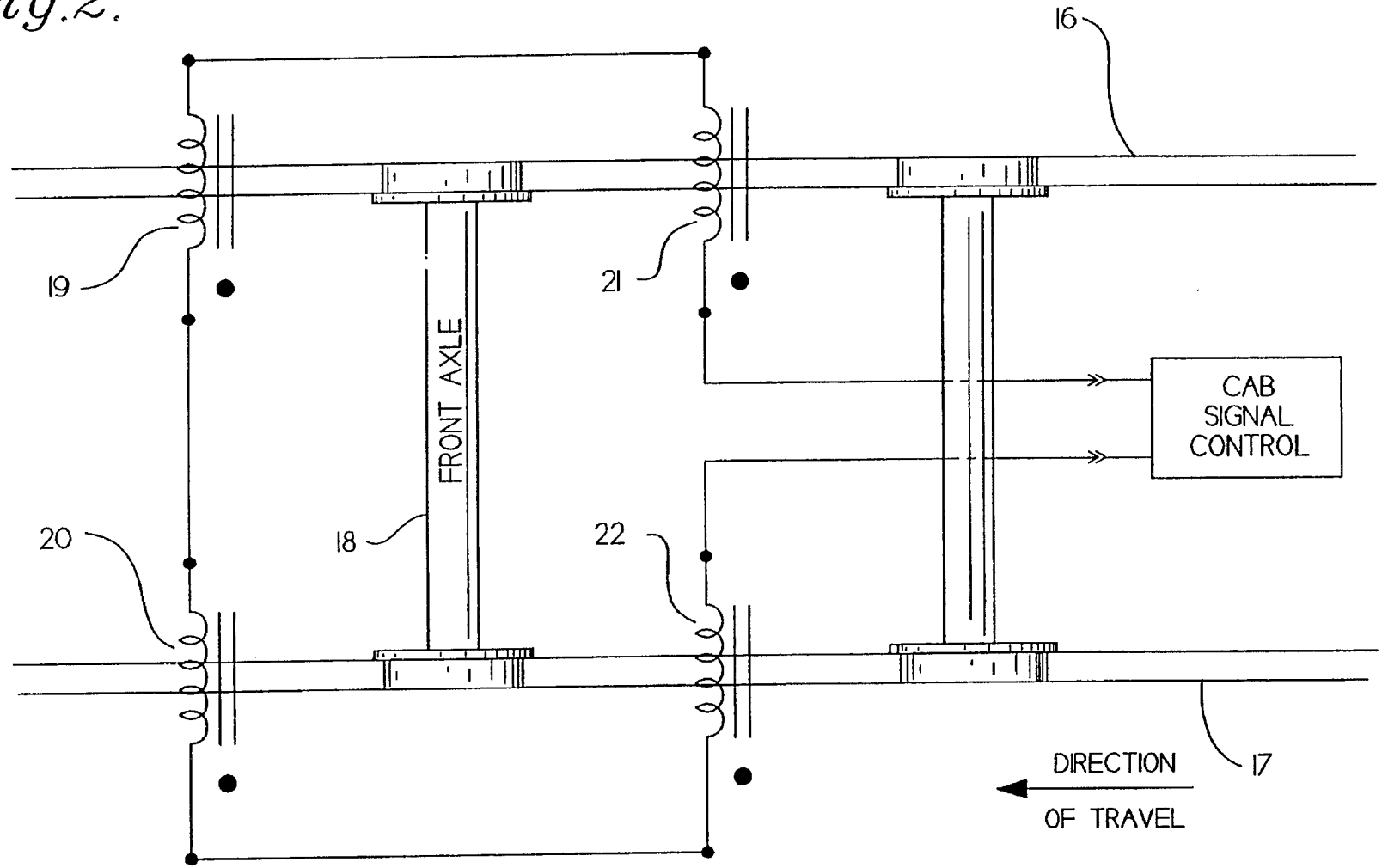
FIG. 2 is a diagrammatic plan view showing an embodiment using two interference sampling coils behind the front axle wheel assembly.

FIG. 2 shows an embodiment of the invention which uses two cab signal receiver pick-up coils 19 and 20, and two interference sampling coils 21 and 22. Lead wheel and axle assembly 18 spans adjacent rails 16 and 17. As can be seen, lead axle 18 completes the electrical circuit between the adjacent rails 16 and 17 providing the shunt path for the cab signal current. The cab signal current would normally be injected into the rails at a remote transmitter from the left side of FIG. 2. The vehicle direction of travel is from right to left so that the lead or front axle 18 provides the shunt current path for the cab signal current. As can be seen, the cab signaling receiver pick-up coils 19 and 20 are mounted in front of the lead axle 18, in an area of rail 16 and 17 where the cab signal current is strongest.

Mounted behind the lead axle are interference sampling coils 21 and 22. In some embodiments it will be preferred that the interference sampling coils are mounted at a similar geometry to the cab signal pick-up coils. The electrical circuit for the four coils 19 through 22 can be seen to have all of the windings connected in series and the output directed to a cab signal front end filter or other cab signal control processing unit. This unit may be of the type that is well-known to those skilled in the art. As will be seen by the polarity of the respective coils 19 through 22, the two cab signal receiving pick-up coils 19 and 20 have their signals added by their series connection to increase the overall strength of the cab signal in the circuit. The respective two interference sampling coils 21 and 22 also have their polarities arranged so that they add or boost the interference signal that they each pick-up. However because both interference sampling coils 21 and 22 have opposite polarities to the respective receiver coils 19 and 20 the interference signal picked-up by coils 21 and 22 will be subtracted from the signals across coils 19 and 20. The signal on coils 19 and 20 both have two components, the desired cab signal component and an undesired interference or noise component. The signals generated across interference sampling coils 21 and 22 because they are positioned behind the front axle do not have the same strong cab signal current imposed thereon, however they still have a substantial electromagnetic interference component. This interference component may be derived primarily from the traction motor and its related power supply. As a result, the interference sampling coils have signals that are identical to or characteristic of the interference component imposed upon receiver pick-up coils 19 and 20. By utilization of the series circuit shown in FIG. 2 and the respective polarities of the pick-up and sampling coils the simple series circuit provides for a means to sum the cab signal components of each of the receiver pick-up coils 19 and 20 and simultaneously subtract (add an opposite polarity) interference signal thereby canceling the interference effect.

An additional advantage of the series circuit connection as shown in FIG. 2 is that should a coil become defective or fail the series circuit then becomes open and a loss of cab signal can be properly evaluated by the on board cab signal control equipment. While the diagram in FIG. 2 shows one possible position for mounting the interference sampling coils, it is to be appreciated that other positions may be equally or more effective in sampling an interference signal which is equal in magnitude to that received by the cab signal pick-up coils. The desire is to pick-up a signal which is generally equal to that interference component received by the cab signal pick-up coils and which may be in an opposing phase so that it may easily be added to the circuit. In this manner the undesired signal in the cab signal pick-up coil will be canceled leaving only the desired signal to be processed by the on board cab signal equipment. Finally it will be desirable to implement the sampling and the cancellation of the interference signal in a vital manner. When using inductive coupling with the sampling device it may be desirable generally to use the sampling coil or coils positioned under the locomotive in a position where it "sees" or senses the interference signal only and not a strong component of the desired cab signal rail current. One such location could be between the first two axles (i.e., behind the lead axle) and mounted relatively close to the floor of the cab. A flux mapping could be used to determine an optimal location for the sampling coil or coils. By monitoring the sampling coils at various positions and comparing them with the signal present from the cab signal receiver pick-up coils, an optimum position can be determined. Wiring the sampling coils in series and varying their position until a zero or null signal appears (with zero track cab signal current) would be one method to determine an optimum position. Other similar methods and other positions may also result in a sampled signal which can be used to cancel the interference component from the cab signal receiving coils. In many embodiments it will be desirable to use sampling coils which are identical to the cab signal coils. In other applications it may be desirable to vary the coil to provide for scaling differences between the respective sampling coils and the receiving coils. As previously stated the series connections allow for a simple shutdown in the event that one of the sampling coils is destroyed. When properly interpreted by the locomotive born cab single equipment the system vitality can be preserved.

Figure 5:
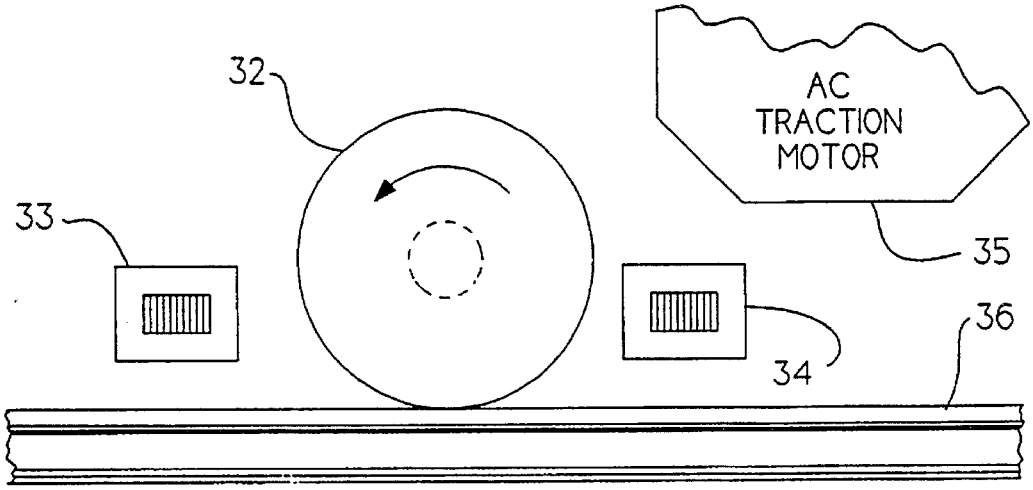
FIG. 5 is a diagrammatic representation showing an embodiment with the position of sampling coils above the rail and behind the lead axle.

FIG. 5 shows a diagrammatic representation of an embodiment similar to that shown in FIG. 2, in a side view. The relative positions of the single receiving coil 33 and the sampling coil 34 can be seen with respect to the lead axle wheel assembly 32. The single receiving coil 33 is in front of the lead axle and spaced above the rail 36. The interference sampling coil 34 is behind the lead wheel/axle assembly 32 and also spaced above the rail. Shown in partial diagrammatic is the AC traction motor 35. While FIG. 5 shows only a single pickup coil 33 and a single sampling coil 34 it is understood that in some embodiments such as that shown in FIG. 2, two signal pick-up coils and two interference sampling coils may be used.

Figure 3:
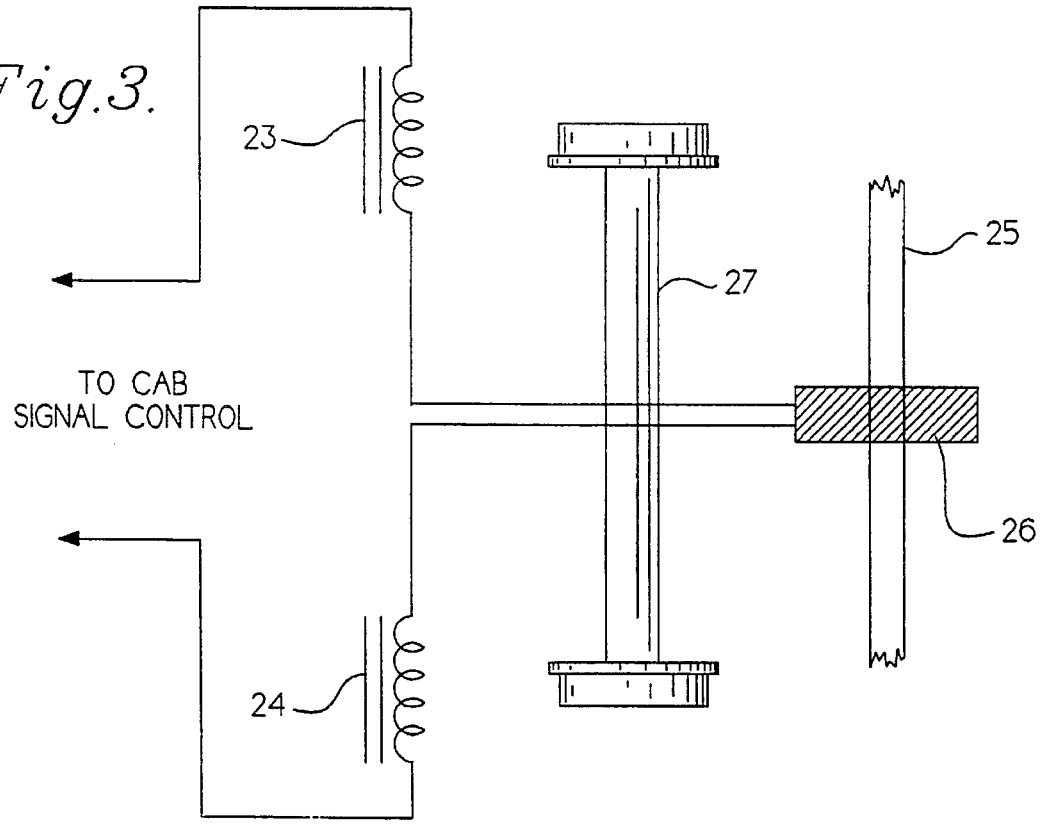
FIG. 3 is a diagrammatic representation of an embodiment showing an interference sampling coil used as a current transformer on the motor power cable.

FIG. 3 shows an embodiment using two signal pick-up coils 23 and 24. These are positioned in front of the lead wheel axle assembly 27. Connected in series with these two pick-up coils is a sampling coil 26 which is used as a current transformer. The current transformer coil 26 is positioned about the motor cable 25 which supplies power to the traction motor. The electromagnetic interference radiating from the motor has a frequency characteristic related to the motor drive current. Therefore motor drive current can be sampled by the current transformer 26 to provide a signal which has the frequency characteristic of the electromagnetic interference. Similar to the embodiment shown in FIG. 2 the interference sampling coil, current transformer 26, is placed in series with the two cab signal pick-up coils 23 and 24. Choosing the polarity and turn ratio of the current transformer 26, a sampling signal of opposite polarity or phase can be derived which cancels the interference component received at coils 23 and 24. Because the cab signal pick-up coils 23 and 24 are in series with the sampling coil current transformer 26, the vitality of the circuit is enhanced because a failure such as an open coil in anyone of the components results in a zero output signal which can be properly interpreted by on board cab signal control apparatus.

Figure 4:
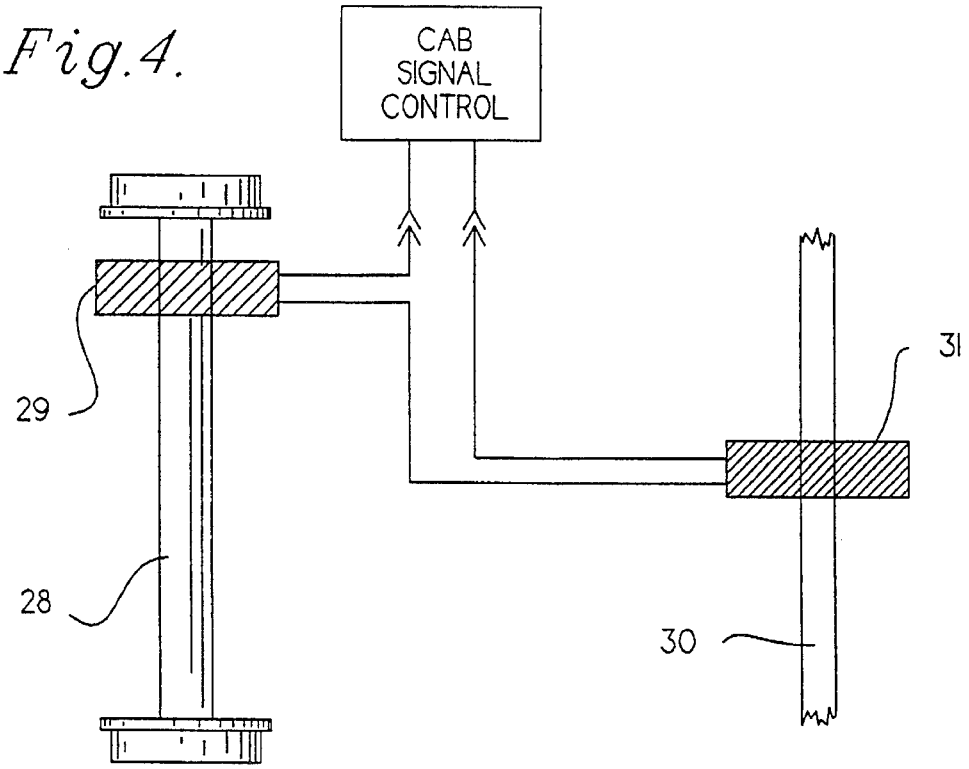
FIG. 4 is a diagrammatic representation showing an embodiment using a current transformer to receive AC cab signals through the lead axle assembly and a sampling coil used as a current transformer on the motor power cables.

The embodiments previously described have used an inductive pick-up coil mounted in front of the lead axle, however other means for receiving the cab signal may be used with this invention. FIG. 4 shows a diagrammatic representation in which the cab signal current is sensed by use of a current transformer coil 29 about the lead wheel axle assembly 28. Such cab signal pick-up coils are described in U.S. Pat. No. 5,234,184, which is incorporated herein by reference. As shown in FIG. 4 lead wheel and axle assembly 28 has positioned about it a cab signal sensing coil 29 which is in the form of a current transformer. Providing the sampling signal is a sampling coil 31 which is in the form of a current transformer similar to that described with regard to the embodiment shown in FIG. 3. Both the cab signal sensing coil current transformer 29 and the sampling coil 31 are connected in series. The sensing coil current transformer 31 is placed about propulsion motor cable 30 which supplies the electrical power to the drive motor. By adjusting the respective turn ratios of the cab signal sensing coil 29 and the sampling coil current transformer 31, the respective signals of the two coils can be such that the interference component of the coil 29 is canceled by the opposing signal on the sampling coil 31. Because the two coils are connected in series vitality can be provided.

Figure 6:
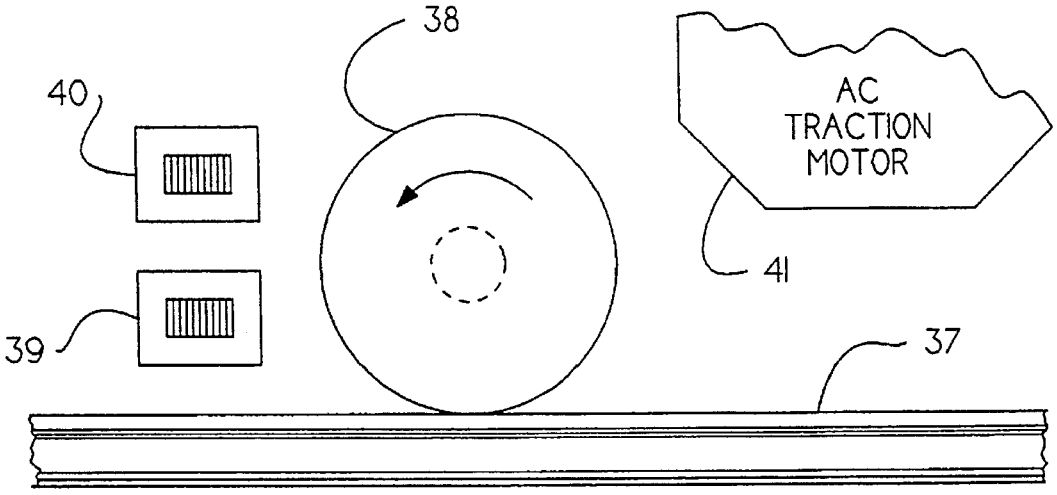
FIG. 6 is a diagrammatic representation showing an embodiment using a sampling coil placed in front of the lead axle and above the cab signal receiving coil.

Another embodiment, shown in FIG. 6, utilizes inductive antennas or pickups for both the cab signal coil and the sampling coil. In this embodiment it may be desirable to utilize identical coils for both the cab signal coils and the sampling coils. The existing well-known pick-up coil/antenna presently utilized in the industry and sold by Union Switch and Signal Inc. (under the designations Track Receiver N396278) may be utilized. This is particularly advantageous since these are existing devices which are well known in the industry and which are available for easy installation and systems repair. Such devices are also compatible with the rugged environment often encountered in the undercarriage location on locomotives and rail vehicles. As shown in FIG. 6 the lead axle wheel assembly 38 rides on rail 37. Propulsion motor 41 is attached to the drive axle in a well known manner. In this embodiment both the cab signal sensing pickup coil 39 and the sampling coil 40 are positioned in advance of the lead wheel and axle assembly 38. As can be understood by viewing FIG. 6, coil 39 is placed above the rail 37 such that the cab signal current inductively couples to the flux concentrator bars in pickup 39. As a result the flux resulting from the track current tends to be maintained in high concentration at and below the pickup coil 39. A substantial reduction in the cab signal flux above the pick-up coil 39 results from the use of the flux concentrator bars and the pick-up coil 39. As a result when the sampling coil 40 is positioned above the cab signal pick-up coil 39 a greatly reduced cab signal current component is generated in the sampling coil 40. However, because the sampling coil 40 is in close proximity to the position of the cab signal pick-up coil 39 the interference component experienced by the pick-up coil 40 can be used to cancel the interference component in the cab signal pick-up 39. The electrical circuit associated with FIG. 6 can be identical to that discussed with regard to FIG. 2, when two cab signal pick-up coils such as 39 are used and two sampling coils such as 40 are used. All four coils can be connected in a series circuit to a cab signal processor unit on board the rail vehicle. The respective polarities of the pick-up coils can, as shown in FIG. 2, be connected so as to boost the respective desired cab signal and cancel the undesired interference component. While some preferred embodiments presently contemplated utilize four coils, two cab signal pickup coils and two sampling coils. Other numbers and combinations of signal sensing coils and sampling coils are included within these embodiments. While these embodiments have been shown with regard to one end of a rail vehicle it will be understood that such devices can be assembled on both ends of rail vehicles so that by bi-directional operation is easily achievable.

While some very specific details have been given with regard to the embodiment shown, it is understood that those skilled in the art will be able to easily modify the techniques of the invention described herein to produce other embodiments which are particularly adapted to specific vehicle or railway conditions. All such other embodiments are included within the scope of the following claims:

I claim:

1. A cab signal receiving apparatus mounted on board a railway vehicle propelled on rail tracks by an electric drive motor and having a lead wheel/axle assembly, such receiving apparatus comprising:

signal receiving means mounted on such railway vehicle for sensing track current and providing a sensed signal;

said sensed signal having a cab signal component and an interference component;

sampling means for providing a sampled signal having the characteristic of electromagnetic interference subjected to said signal receiving means by the magnetic field of such electric motor; and means for subtracting said sampled signal from said sensed signal such that said interference component is reduced.

2. The invention of claim 1 wherein said receiving means includes at least one receiver coil arranged to inductively couple to such track current and said sampling means including at least one sampling coil arranged to pick-up electromagnetic interference characteristic of the electromagnetic interference subjected to said at least one receiver coil.

3. The invention of claim 2 wherein said at least one receiving coil includes a plurality of receiving coils, and said at least one sampling coil includes a sampling coil for each of said receiving coils, arranged with a respective one of said receiving coils to pick-up electromagnetic interference characteristic of said respective one of said receiving coils.

4. The invention of claim 3 wherein said means for subtracting said sampled signal from said sensed signal includes a series electrical arrangement of said sampling coils and said receiving coil with respective polarities of said sampling coils being opposite to respective polarities of said receiving coils.

5. The invention of claim 3 wherein said plurality of receiving coils include two receiving coils connected in a series circuit to add respective outputs of said two receiving coils; and said at least one sampling coil includes two sampling coils connected in a series circuit to add respective outputs of said two sampling coils.

6. The invention of claim 5 wherein said means for subtracting said sampled signal from said sensed signal includes a series electrical arrangement of said sampling coils and said receiving coils with respective polarities of said sampling coils being opposite to polarities of said receiving coils.

7. The invention of claim 3 wherein said pluralities of receiving coils include at least one said receiving coil positioned in front of such lead wheel/axle assembly; and said sampling coils include at least one sampling coil positioned in front of such lead wheel/axle assembly.

8. The invention of claim 7 wherein at least one of said sampling coils is positioned above a respective one of said receiving coils.

9. The invention of claim 7 wherein at least one of said sampling coils is positioned directly above a respective one of said receiving coils.

10. The invention of claim 3 wherein said receiving coils include at least one coil in front of such lead wheel/axle assembly; and said sampling coils include at least one sampling coil positioned behind such lead wheel/axle assembly.

11. The invention of claim 8 wherein said plurality of receiving coils include two receiving coils connected in a series circuit to add respective outputs of said two receiving coils; and said sampling coils include two sampling coils connected in a series circuit to add respective outputs of said two sampling coils.

12. The invention of claim 9 wherein said plurality of receiving coils include two receiving coils connected in a series circuit to add respective outputs of said two receiving coils; and said sampling coils include two sampling coils connected in a series circuit to add respective of said two sampling coils.

13. The invention of claim 10 wherein said plurality of receiving coils include two receiving coils connected in a series circuit to add respective outputs of said two receiving coils; and said sampling coils include two sampling coils connected in a series circuit to add respective outputs of said two sampling coils.

14. The invention of claim 1 wherein said receiving means includes at least one receiver coil arranged as a current transformer about such lead wheel/axle assembly.

15. The invention of claim 1 wherein said sampling means includes at least one sampling coil arranged to be a current transformer about an electrical conductor supplying electrical power current to such drive motor.

16. The invention of claim 14 wherein said sampling means includes at least one sampling coil arranged to be a current transformer about an electrical conductor supplying electrical power current to such drive motor.

17. The invention of claim 15 wherein said signal receiving means includes two receiving coils positioned in front of such lead wheel/axle assembly.

18. The invention of claim 17 wherein said sampling coil and said two receiving coils are arranged in a series electrical circuit with the polarity of such sampling coil oriented to generate a sampled signal that is in inverted phase relation to said interference component of such sense signal from said receiving coils.

19. A method of receiving railway cab signals on board a railway vehicle having a lead wheel/axle assembly and propelled by an electric drive motor comprising:

sensing a track signal current and providing a sensed signal having a cab signal component and an interference component;

sampling electromagnetic radiation on board such vehicle at a location having an interference characteristic of said interference component;

providing a sampled signal with said interference characteristic; and subtracting said sampled signal from said sensed signal.

20. The method of receiving railway cab signals on board a railway vehicle of claim 19 wherein said sensing is at a position in front of such lead wheel/axle assembly.

21. The method of receiving railway cab signals on board a railway vehicle of claim 20 wherein said sampling is taken at a position behind such lead wheel/axle assembly.

22. The method of receiving railway cab signals on board a railway vehicle of claim 20 wherein said sampling is taken at a position in front of such lead wheel/axle assembly.

23. The method of receiving railway cab signals on board a railway vehicle of claim 22 wherein said sampling is taken directly above said sensing position.

24. The method of receiving railway cab signals on board a railway vehicle of claim 19 wherein said sampling is taken by sensing motor current of such drive motor.

25. The method of receiving railway cab signals on board a railway vehicle of claim 24 wherein said sensed signal is provided by sensing the rail current in such wheel/axle assembly.

26. The method of receiving railway cab signals on board a railway vehicle of claim 20 wherein said sampling is taken by sensing motor current of such drive motor.

27. The method of receiving railway cab signals on board a railway vehicle of claim 20 wherein said sensed signal is provided by sensing the rail current in such wheel/axle assembly.

* * * * *

UNITED STATES PATENT AND TRADEMARK OFFICE

CERTIFICATE OF CORRECTION

PATENT NO. : 5,501,416

DATED : March 26, 1996

INVENTOR(S) : RONALD R. CAPAN

It is certified that error appears in the above-indentified patent and that said Letters Patent is hereby corrected as shown below:

Column 8, line 9, claim 12, after "respective" insert --outputs--.

Signed and Sealed this

Fourteenth Day of January, 1997

Bruce Lehman

*Attest:*

BRUCE LEHMAN

*Attesting Officer*

*Commissioner of Patents and Trademarks*